United States Patent [19]

Schmeling et al.

[11] Patent Number: 4,976,830

[45] Date of Patent: Dec. 11, 1990

[54] METHOD OF PREPARING THE SURFACES OF MAGNESIUM AND MAGNESIUM ALLOYS

[75] Inventors: Edith L. Schmeling, Brühl-Badorf; Benno Röschenbleck, Osnabrück; Michael H. Weidemann, Kerpen-Horrem, all of Fed. Rep. of Germany

[73] Assignee: Electro Chemical Engineering GmbH, Zug, Switzerland

[21] Appl. No.: 321,253

[22] Filed: Mar. 9, 1989

[30] Foreign Application Priority Data

Mar. 15, 1988 [DE] Fed. Rep. of Germany ..... 3808610

[51] Int. Cl.[5] ..... C25D 11/30

[52] U.S. Cl. ..... 204/58.4

[58] Field of Search ..... 204/58.4

[56] References Cited

U.S. PATENT DOCUMENTS 2,880,148 3/1959 Evangelides ..... 204/58.4

*Primary Examiner*—T. M. Tufariello

*Attorney, Agent, or Firm*—Sprung Horn Kramer & Woods

[57] ABSTRACT

A method of preparing the surfaces of magnesium and magnesium alloys by anodic oxidation. To produce protective coatings that have little or no inherent color, that can easily be colored, that provide a satisfactory adhesive base for lacquering or subsequent processing, and that exhibit outstanding resistance to corrosion and wear on magnesium and magnesium alloys by anodic oxidation, an alkali-rich aqueous electrolyte bath containing (a) borate or sulfonate anions and (b) phosphate and fluoride or chloride ions and adjusted to a pH of 8 to 12 and preferably 10.5 to 11.5 is employed. A direct current is applied and is either briefly turned off or its polarity incompletely reversed to allow the formation of magnesium phosphate and magnesium fluoride or magnesium chloride and optionally magnesium aluminate.

16 Claims, No Drawings

METHOD OF PREPARING THE SURFACES OF MAGNESIUM AND MAGNESIUM ALLOYS

Magnesium is becoming increasingly significant as a light-weight metal structural material (with a density of 1.74 g/cm$^3$) in many industries—aircraft construction, space technology, optics, and automobile manufacturing, for example. Magnesium, however, has the drawback as a structural material that it does not resist corrosion very well without preliminary surface treatment. Many methods of increasing the resistance to corrosion and wear of magnesium are known. These methods include such chemical and electrochemical processes as chromating and anodic oxidation.

In anodic oxidation, the degreased magnesium parts are immersed as anodes in an electrolyte bath. When current flows through the bath, the negatively charged ions migrate to the anode, where they become discharged. This process is accompanied by the occurrence of atomic oxygen, which leads to the formation of magnesium oxide. The resulting anodic coating is securely anchored to the surface of the magnesium.

The known electrochemical methods of coating magnesium by anodic oxidation employ either powerful oxidants or peroxides or substances that are converted into peroxy compounds during anodic polarization (e.g. Canadian Pat. No. 568,653). It can be assumed that the oxygen responsible for the oxidation results from the breakdown of the peroxy compounds, which then proceed to reconstitute themselves at high current densities in the pores of insulating coating on the magnesium. When such powerful oxidants as chromates, vanadates, and permanganates are employed, the atomic oxygen derives from the reduction of whatever element is present in the oxidant at its highest oxidation stage, followed by reoxidation.

The oxidants or peroxy compounds employed in the known methods of anodically oxidizing magnesium or magnesium alloys contain such transition metals as chromium, vanadium or manganese. This situation has turned out to be a drawback in that some of the transition-metal compounds become established in the protective coating on the surface of the magnesium, as becomes evident from its color. The insertion of these compounds lowers the resistance of the protective coating to corrosion and wear.

The object of the present invention is accordingly to produce protective coatings that have little or no inherent color, that can easily be colored, that provide a satisfactory adhesive base for lacquering or subsequent processing, and that exhibit outstanding resistance to corrosion and wear on magnesium and magnesium alloys by anodic oxidation.

This object is realized by a method of anodic oxidation that employs an alkali-rich aqueous bath containing (a) borate or sulfate anions and (b) phosphate and fluoride or chloride ions and adjusted to a pH of 8 to 12 and preferably 10.5 to 11.5.

Direct current is employed and is either briefly turned off or its polarity incompletely reversed to allow the formation of manganese phosphate and magnesium fluoride or magnesium chloride and optionally magnesium aluminate.

It has surprisingly been demonstrated that a protective coating that is especially resistant to corrosion and wear can be produced on magnesium or magnesium alloys by anodic oxidation when the foregoing conditions are simultaneously observed. The atomic oxygen needed to oxidize the magnesium is provided in accordance with the invention by using borate or sulfate anions that form peroxides and, although they decompose readily, easily reconstitute themselves, due to the high current density, in the pores of the resulting protective coating. Borate and sulfate anions have proven to be especially appropriate in that, as a result of the conversion, they arrive only to a limited extent at the cathode, where they become reduced.

It has also been discovered that the electrolyte must contain anions that form difficult-to-dissolve compounds in conjunction with the magnesium that is being oxidized. These anions consist in accordance with the invention of phosphate ions combined with fluoride or chloride ions. When an alloy of magnesium and aluminum is to be anodically oxidized in accordance with the invention, aluminate ions come into existence from the aluminum that is present and join with the magnesium ions to form a difficult-to-dissolve magnesium aluminate.

The resulting protective coating must also contain pores or conductive sites to ensure a sufficient flow of current. This is attained in accordance with the invention by the fluoride or chloride ions added to the electrolyte.

It has also been demonstrated that it is important to maintain the correct ratio of anions to cations in the vicinity of the magnesium surface that is being coated because that is the only way to obtain a sufficiently stable and dense protective coating. Maintaining a constant direct current would lead to enrichment of the anions in the vicinity of the anode. The anions that would be particularly enriched are $OH^-$ ions, which are especially mobile. The occurrence of $Mg(OH)_2$ in the protective coating is especially desirable, because of the way it accepts color and in terms of subsequent treatment, in conjunction with alkali silicate.

The bath in accordance with the invention is accordingly adjusted to pH of 8 to 12 and preferably 10.5 to 11.5, especially by adding buffers.

It is possible to obtain in the vicinity of the surface being coated the desired concentration of anions that are to be inserted into the protective coating by employing a direct current that is briefly turned off or has its polarity incompletely reversed instead of a continuous direct current in order to allow the formation of manganese phosphate and magnesium fluoride or magnesium chloride and, when a magnesium alloy that contains aluminum is being oxidized, the formation of magnesium aluminate.

It is preferable to employ a continuous direct current with an alternating current superposed over it at a frequency of 10 to 100 Hz. The alternating current can be superposed by connecting a source of direct current to a source of sine current in series such that the alternating current is 15 to 30% of the direct current. An alternating current with an adjustable frequency to superpose over the direct current can be generated with frequency converters. Frequency converters are for example motor-generator units with speeds that can be varied to obtain a proportional change in frequency. The alternating current in this case is adjusted with a variable transformer to the desired percentage of direct current. The line frequency, 50 Hz in the Federal Republic of Germany and 60 Hz in the U.S. for example, is preferably employed.

To decrease the expense of obtaining an appropriate current contour, however, the anodic oxidation in accordance with the invention can also be carried out with a rectified alternating current at a frequency of 50 or 60 and with a ripple of 15 to 35%. The current can be rectified with an M1 one-way circuit or preferably with an M2 midpoint circuit (in accordance with DIN Draft 41 761). The resulting current can be smoothed with matching inductances that reduce the ripple to 15 to 35% (cf. e.g. R. Jäger, Leistungselektronik Grundlagen und Anwendungen, Berlin, 1977, p. 75).

As as alternative it is also possible to work with a direct current that is pulsed at 30 to 70 Hz, with the cut-out time between two voltage pulses lasting between as long as and twice as long as the voltage pulse. The direct current can be pulsed with either electronic or mechanical switches activated by a frequency generator. Appropriate electronic switches for example are switching thyristors. A similar current contour can also be obtained by M1 half-wave rectifying an alternating current of 30 to 70 Hz and trimming the phase (in accordance with DIN Draft 41 761). The phase-trimming angle can be varied to control the length of the voltage pulse (cf. e.g. O. Limann, Elektronik ohne Ballast, Munich, 1973, p. 347).

It is preferable to work with a voltage that increases to 100 volts. The current density is in particular 1 to 6 $A/dm^2$.

An alkali-rich aqueous electrolyte in accordance with the invention is preferably to be understood as one that contains between 0.9 and 8.5 moles/l of alkali ions. Alkali ions are those of the alkali metals lithium, sodium, potassium, etc. The ammonium ion is not considered an alkali ion in the present context.

The content of borate and sulfate ions in the aqueous electrolyte is preferably 10 to 80 g/l. The content of phosphate ions, in terms of $H_3PO_4$ is preferably 10 to 70 g/l. The amount of fluoride or chloride ions to be employed in conjunction with the phosphate ions is 5 to 35 g/l in terms of HF or HCl.

Before being subjected to anodic oxidation subject to the conditions in accordance with the invention, the pieces of magnesium or magnesium alloy are subjected to the conventional preliminary chemical degreasing treatments, especially alkaline cleaning in a powerful alkaline bath.

Degreasing is followed by conventional acid etching, for example with dilute aqueous solutions of phosphoric acid and sulfuric acid, and if necessary by activation with hydrofluoric acid.

The protective coatings produced on the surface of the magnesium or magnesium alloy in accordance with the invention are preferably also lacquered or subjected to further processing.

The protective coatings produced in accordance with the invention constitute a very satisfactory adhesive base for lacquers of the kind conventionally employed for pieces of magnesium, aluminum or zinc. These materials are two-constituent lacquers based on polyurethane and acrylic-resin, epoxide-resin, and phenolic-resin lacquers, etc.

Among the many materials tested were the commercially available products

1. Aqualac 8,
2. VP 5140 methacrylate (Degussa),
3. VKS 20 (phenolic resin),
4. Araldit 985 E,
5. water glass+$CO_2$, and
6. a dispersion of PTFE.

Products 3, 4, 5, and 6 resulted in a definitely perceptible increase in the coatings' resistance to corrosion. The coating treated in Product 6 also resulted in a considerable decrease in the coefficient of friction.

To improve the tribological properties (slipperiness and dry-lubricant properties) of a surface coated in this way, it can then be subjected to further treatment with a solid lubricant, which can anchor in the available pores. Among the appropriate lubricants are fluorinated and/or chlorinated aliphatic and aromatic hydrocarbon compounds and molybdenum disulfide and graphite.

The protective coatings in accordance with the invention can also be subsequently treated with the aqueous solution of an alkali silicate. The result of this treatment is reaction of the $MgOH_2$ in the protective coating, especially in the pores, with the alkali silicate into difficult-to-dissolve magnesium silicate and alkali hydroxide. Once the piece with the protective coating has been removed from the alkali-silicate bath, it is preferably exposed in a second stage to an atmosphere rich in carbon dioxide. At this stage the "water glass" left over from the silicate treatment will in conjunction with the $CO_2$ from the atmosphere form $SiO_2$ and alkali carbonate as the more powerful carbonic acid expels the weaker silicic acid out of its compound. The $SiO_2$ will seal the pores in the protective coating, a process accelerated by contact with the $CO_2$. Since $SiO_2$ will rapidly precipitate from the outer vicinity of the pores when more powerful acids are employed, the alkali silicate inside the pores will no longer be able to react. The thoroughgoing precipitation of $SiO_2$ in the pores occasioned by the weak carbonic acid on the other hand will result in considerably more effective protection against corrosion.

The present invention also concerns magnesium alloys coated with a protective coating containing magnesium phosphate, hydroxide and fluoride that is 15 to 30 μm thick and will resist wear with a loss of mass measuring less than 40 mg following 10,000 revolutions in a Taber abrader (CS 10, 10N).

A protective coating that satisfies the foregoing conditions can be applied by the method in accordance with the invention previously described herein for example.

The corrosion resistance of the magnesium alloys in accordance with the invention is, once the protective coating has been applied, preferably less than 15 corrosion points/$dm^2$ when a sample of the alloy is exposed for 240 hours in the salt-spray test in accordance with DIN 50021 SS.

Materials that are appropriate for producing a protective coating that is resistant to corrosion and wear by the method in accordance with the invention are, in addition to pure magnesium, those designated by the ASTM as AS 41, AM 60, AZ 61, AZ 63, AZ 81, AZ 91, AZ 92, HK 31, QE 22, ZE 41, ZH 62, ZK 51, ZK 61, EZ 33, and HZ 32 and the forging alloys AZ 31, AZ 61, AZ 80, M 1, ZK 60, and ZK 40.

The protective coating employed with the magnesium alloys in accordance with the invention preferably also contains borate, aluminate, phenolate or silicate ions. The pores of the protective coating in particular preferably contain silicon dioxide, which can be obtained by subsequently treating the protective coating with an aqueous solution of an alkali silicate as previously described herein. The protective coating applied to the magnesium alloys in accordance with the invention is white to whitish gray or tan.

The method in accordance with the invention will now be explained in greater detail with reference to examples.

EXAMPLE 1

The surfaces of objects made of the magnesium alloy GD-MG Al 9 Zn 2 were initially treated in an alkaline cleaning bath composed of

| | |
|---|---|
| sodium hydroxide | 50 g/l |
| trisodium phosphate | 10 g/l |
| wetting agent—synthetic soap | 1 g/l |

The treatment in the alkaline cleaning bath was followed by etching in a bath composed of

| | |
|---|---|
| phosphoric acid (85%) | 380 ml/l |
| sulfuric acid (98%) | 16 ml/l |
| water | 604 ml/l |

The etching occurred at a temperature of 20° C. and lasted approximately 30 seconds. The etching was followed by activating the surface of the sample in hydrofluoric acid.

The samples were then anodized in an electrolyte composed of

| | |
|---|---|
| potassium fluoride (KF) | 35 g/l |
| sodium phosphate ($Na_3PO_4$) | 35 g/l |
| potassium hydroxide (KOH) | 165 g/l |
| aluminum hydroxide ($Al(OH)_3$) | 35 g/l |
| boric acid ($H_3BO_4$) | 10 g/l |

The current was a rectified alternating current with a ripple of approximately 20% and a current density of 1 to 5.5 A/dm$^2$. The final voltage was 60 V. The exposure time was 15 minutes.

The result was a white coating 25 μm thick that could be colored especially satisfactorily with commercially available colorants. Once colored, the protective coatings were treated with commercially available water glass at a concentration of 50 g/l and a temperature of 95° C. for 15 minutes, dried, and exposed to a $CO_2$ atmosphere in a desiccator, during which time the water glass, including that in the depths of the pores, slowly turned into $SiO_2$. Subsequent to this densification, the coating exhibited 5 corrosion points after 500 hours in a DIN 50 021 SS corrosion test.

The mass lost subsequent to $10^4$ revolutions in the Taber abrader test was 38 mg.

It is understood that the specification and examples are illustrative but not limitative of the present invention and that other embodiments within the spirit and scope of the invention will suggest themselves to those skilled in the art.

We claim:

1. A method of preparing the surface of magnesium or a magnesium alloy by anodic oxidation, comprising immersing the magnesium or magnesium alloy in an alkali-rich aqueous electrolyte bath containing (a) sulfate anions and (b) phosphate and chloride ions at a pH of about 8 to 12, applying a pulsed direct current to the bath, whereby on the surface of the magnesium or its alloy there is formed magnesium phosphate and magnesium fluoride or magnesium chloride.

2. The method according to claim 1, wherein the pulsed direct current comprises a continuous direct current with an alternating current superposed over it at a frequency of about 10 to 100 Hz and a current density of about 15 to 35% of the direct current.

3. The method according to claim 1, wherein the pulsing of the direct current is carried out with a rectified alternating current with a ripple of about 15 to 35%.

4. The method according to claim 1, wherein it is carried out with a direct current that is pulsed at about 30 to 70 Hz, with the cut-out time between two voltage pulses lasting between as long as and twice as long as the voltage pulse.

5. The method according to claim 1, wherein the current density is between about 1 and 6 A/dm$^2$.

6. The method according to claim 1, wherein the voltage pulses to 100 V.

7. The method according to claim 1, wherein the bath contains between about 0.9 and 8.5 moles/l of alkali ions.

8. The method according to claim 1, including the further step of coating an aqueous solution of an alkali silicate.

9. Method as in claim 8, including the further step of exposing the material, following the alkali-silicate treatment, to an atmosphere rich in carbon dioxide.

10. The method according to claim 1, including the further step of lacquering the protective coating.

11. The method according to claim 1, wherein the material treated is an aluminum-containing magnesium alloy, and on its surface the material formed includes magnesium aluminate.

12. A magnesium alloy coated with a protective layer containing magnesium phosphate, hydroxide and fluoride, that is 15 to 30 μm thick and resists wear with a loss of mass measuring less than about 40 mg following 10,000 revolutions in a Taber abrader (CS 10, 10N).

13. A magnesium alloy according to claim 11, having a corrosion resistance of less than about 15 corrosion points/dm$^2$ subsequent to exposure to a salt-spray test for 240 hours in accordance with DIN 50 021 SS.

14. A magnesium alloy according to claim 12, wherein the protective coating also contains magnesium borate, aluminate, phenolate or silicate.

15. A magnesium alloy according to claim 12, wherein the protective coating contains silicon dioxide.

16. A magnesium alloy according to one of claim 12, wherein the protective coating is white to whitish gray or tan.

* * * * *